US012595570B2

(12) United States Patent
Scheffer et al.

(10) Patent No.: US 12,595,570 B2
(45) Date of Patent: Apr. 7, 2026

(54) METHOD FOR OPERATING AN ELECTROLYSIS PLANT, AND ELECTROLYSIS PLANT

(71) Applicant: Siemens Energy Global GmbH & Co. KG, Munich (DE)

(72) Inventors: Klaus Scheffer, Nuremberg (DE); Erik Wolf, Röttenbach (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 18/857,034

(22) PCT Filed: Jan. 20, 2023

(86) PCT No.: PCT/EP2023/051401
§ 371 (c)(1),
(2) Date: Oct. 15, 2024

(87) PCT Pub. No.: WO2023/198328
PCT Pub. Date: Oct. 19, 2023

(65) Prior Publication Data

US 2025/0257475 A1 Aug. 14, 2025

(30) Foreign Application Priority Data

Apr. 12, 2022 (DE) ..... 10 2022 203 691.3

(51) Int. Cl.
*C25B 1/042* (2021.01)
*C25B 9/23* (2021.01)
(Continued)

(52) U.S. Cl.
CPC ..... *C25B 1/042* (2021.01); *C25B 9/23* (2021.01); *C25B 9/67* (2021.01); *C25B 15/02* (2013.01); *C25B 15/021* (2021.01); *C25B 15/08* (2013.01)

(58) Field of Classification Search
None
See application file for complete search history.

(56) References Cited

U.S. PATENT DOCUMENTS

2010/0187128 A1 7/2010 Neubert et al.
2011/0198232 A1 8/2011 Cipollini et al.
2016/0068975 A1 3/2016 Smarsch et al.

FOREIGN PATENT DOCUMENTS

CN 113667997 A 11/2021
DE 3101210 A1 7/1982
(Continued)

*Primary Examiner* — Wojciech Haske
(74) *Attorney, Agent, or Firm* — Laurence A. Greenberg; Werner H. Stemer; Ralph E. Locher

(57) ABSTRACT

The invention relates to a method for operating an electrolysis plant which has an electrolyzer for generating hydrogen and oxygen as product gases, wherein water is fed as educt water to the electrolyzer and split into hydrogen and oxygen at an ion-exchange membrane. Prior to splitting, the educt water is brought into a thermodynamic state close to the boiling point of the water in terms of the pressure and temperature and is fed in this state to the membrane. Educt water is brought to a boil at the membrane and converted into the gas phase, wherein the water in the gas phase is split at the membrane. There is also described an electrolysis plant having an electrolyzer for generating hydrogen and oxygen as product gases.

13 Claims, 2 Drawing Sheets

(51) Int. Cl.

| | |
|---|---|
| ***C25B 9/67*** | (2021.01) |
| ***C25B 15/02*** | (2021.01) |
| ***C25B 15/021*** | (2021.01) |
| ***C25B 15/08*** | (2006.01) |

(56) References Cited

FOREIGN PATENT DOCUMENTS

| | | | | | |
|---|---|---|---|---|---|
| DE | 102005017727 | A1 | | 11/2005 | |
| DE | 102014213990 | A1 | | 1/2016 | |
| WO | WO 2012162434 | A2 | | 11/2012 | |
| WO | WO 2012167375 | A1 | | 12/2012 | |
| WO | WO-2021242150 | A1 | * | 12/2021 | ..... C25B 15/021 |

* cited by examiner

METHOD FOR OPERATING AN ELECTROLYSIS PLANT, AND ELECTROLYSIS PLANT

FIELD AND BACKGROUND OF THE INVENTION

The invention relates to a method for operating an electrolysis plant and to an electrolysis plant comprising an electrolyzer for generating hydrogen and oxygen as product gases.

Hydrogen is an important substance that is used in numerous applications in industry and technology. As a general rule, hydrogen occurs on Earth only in a bound state. One of those substances that contains hydrogen in the bound state is water. Hydrogen can in addition also be used as an energy store, particularly in order to store electrical energy generated by means of regenerative energy generation methods for subsequent applications.

An important process for obtaining hydrogen is the electrolysis of water, in particular using electrical energy. Hydrogen can in this case serve inter alia as an energy store, by using it for example as a fuel in order to provide a more constant supply of electrical energy from renewable energies in particular, for example wind power, photovoltaics or the like. It is however also possible to use hydrogen for other processes in which a fuel or a reducing agent is needed. The hydrogen obtained in electrolysis can thus for example be used industrially or electrical energy can be recovered electrochemically using fuel cells.

The separation of water into its chemical constituents hydrogen and oxygen can be carried out by means of suitable electrolysis cells. For this purpose, these can take the form of what are known as polymer electrolyte membrane electrolysis cells. Usually provided in an electrolysis cell of this kind is a membrane that has a catalyst layer on each of the surfaces facing away from one another. The catalyst layers are usually adjoined by respective gas diffusion layers, which in turn are adjoined by respective electrically conductive contact plates, occasionally also referred to as bipolar plates, which are used inter alia for electrical contacting. At the same time, the contact plates, or bipolar plates, are preferably also designed so as to be able to permit the required mass transfer when operated in the correct manner during the electrolysis in the electrolysis cell. For this purpose, appropriate channels can be provided for supplying a respectively suitable electrolyte and for discharging the reaction products of the electrolysis, namely hydrogen gas and oxygen gas. The gas diffusion layer generally provides electrical conductivity in order to electrically couple the contact plates and the catalyst layers to one another. This makes it possible to realize the desired electrochemical reaction in the region of the catalyst layers.

When the electrolysis reaction is a reaction in the alkaline range, an anion-exchange membrane (AEM) is provided as the membrane. On the other hand, when the electrolysis reaction takes place in the acid range, a proton-exchange membrane (PEM) is provided instead.

Hydrogen is produced from water via the electrolysis process. This is an electrochemical operation in which water is separated into its chemical constituents oxygen and hydrogen. Depending on the mode of operation, the electrochemical cell reactions can be described and differentiated as follows:

Alkaline Electrolysis:

| | | |
|---|---|---|
| Anode electrode | $4OH^- \rightarrow 2H_2O + O_2 + 4e^-$ | (1) |
| Cathode electrode | $2H_2O + 2e^- \rightarrow 2OH^- + H_2$ | (2) |

Acidic Electrolysis:

| | | |
|---|---|---|
| Anode electrode | $2H_2O \rightarrow 4H^+ + O_2 + 4e^-$ | (1) |
| Cathode electrode | $4H^+ + 4e^- \rightarrow H_2$ | (2) |

In a polymer electrolyte membrane electrolysis, the respective two subreactions are spatially separated by an ion-conducting membrane. In an electrolysis in the alkaline range it is an anion-exchange membrane (AEM) that is provided here, whereas in an electrolysis in an acidic environment a proton-exchange membrane (PEM) is provided. The construction of the membrane electrode assembly (MEA) can however in both cases be fundamentally comparable.

These electrolyses generally take place at pressures and temperatures at which the water to be broken down is present in the liquid state, hence this is referred to as low-temperature electrolysis. This is the case both for the widely used alkaline electrolyses and for PEM electrolyses.

A large part of the electrical energy that has to be applied for this type of electrolysis is expended on the change in phase of the liquid water into the gas phase that is required. Only in this way is the thermodynamic phase change necessary for the electrochemical decomposition of water made possible in order ultimately to bring about the above-described electrode reactions in the gas phase. A correspondingly large cell voltage or overvoltage must be provided for such process control in low-temperature electrolysis. In addition, complex plant systems must be provided, as well as costly materials such as catalysts obtained from rare and very costly materials, particularly in the case of PEM electrolysis, which are prone to degradation.

Systems have been proposed for high-temperature electrolyses (HTE), for example a solid oxide electrolyzer, in which the electrolyzer is already being fed with water present in vapor form at very high temperature. The high-temperature electrolyzers are here operated far above the boiling temperature of water at steam temperatures of typically well over 500° C. A reliable technical implementation of this technology on an industrial scale is currently associated with many unsolved technical challenges, even though basic approaches have long been known.

For instance, DE 31 01 210 A1 describes the constructive design of a modular unit for the high-temperature electrolysis. In this system for a high-temperature steam electrolysis, a large number of zirconium oxide electrolysis tubes are connected together into modular units. At the point of connection of electrolysis tube and support body, very high demands are placed on the mechanical stability at operating temperatures of approx. 950° C. and on absolute gas-tightness. These demands are associated with high use of costly high-temperature materials, for example zirconium oxide.

A method and an apparatus for high-temperature steam electrolysis are described in DE 10 2005 017 727 A1. In the high-temperature steam electrolysis described therein, also referred to as "Delyse", the Delyse cell is designed as a two-channel vessel with a solid electrolyte. Steam is introduced into the outer of the two channels at high temperature and high pressure and decomposed into hydrogen and oxygen, wherein the ionized oxygen is transported through the solid electrolyte, discharged, and conducted away. The hot steam supplied here is at a process temperature greater than 700° C. at a process pressure of greater than 40 bar, preferably even a process temperature of 800° C. at a process pressure of 50 bar. Keeping this under control is technically extremely demanding for industrial operation and also requires, in addition to massive pressure vessels and reaction chambers, very high and costly use of materials for the electrodes, for example platinum and zirconium oxide. Moreover, the operating ranges for HTE are at the present time narrow, i.e. very restricted, which means the efficiency advantages due to the high process temperatures compensate for this disadvantage only to a limited extent. A problem with the use of fluctuating electrolysis current is the narrower operating range compared with alkaline or PEM electrolyzers, as are the unavoidable material stresses during load changes caused by the high thermal stresses.

SUMMARY OF THE INVENTION

Against the background of these disadvantages, it is an object of the invention to specify a method for operating an electrolysis plant with which particularly efficient and flexible operation is possible alongside high uptime.

A further object is to specify an electrolysis plant with which efficient and flexible operation can be technically easily realized.

The object directed at a method for operating an electrolysis plant is according to the invention achieved by a method for operating an electrolysis plant comprising an electrolyzer for generating hydrogen and oxygen as product gases, wherein water is supplied to the electrolyzer as reactant water and is split into hydrogen and oxygen at an ion-exchange membrane, wherein, prior to splitting, the reactant water is brought to a thermodynamic state close to the boiling point of the water with regard to the pressure and temperature and is supplied in this state to the membrane, wherein reactant water is brought to the boil at the membrane and thereby passes into the gas phase, and wherein reactant water in the gas phase is split at the membrane.

The invention is already based on the recognition that both low-temperature and high-temperature electrolyses have disadvantages. Thus, for a low-temperature electrolysis, a large part of the electrical energy that has to be applied for this type of electrolysis must be expended on the heating of the liquid water that is required and change in phase thereof into the gas phase. Only in this way is the thermodynamic phase change necessary for the electrochemical decomposition of water made possible in order ultimately to bring about the above-described electrode reactions in the gas phase and to expel the product gases-hydrogen and oxygen. In order to achieve this, a correspondingly large cell voltage or overvoltage must be provided for such process control in low-temperature electrolysis. In addition, complex plant systems need to be provided, as well as costly materials such as catalysts obtained from rare and very costly materials, particularly in the case of PEM electrolysis, which are prone to degradation during operation. As a consequence, the duration of usability, what is known as the "service life" of the catalyst or membrane, is for example limited, since economic operation of the electrolysis plant is possible only with adequate activity and selectivity.

Although they already work with highly heated water under high pressures in the gas phase as working medium (reactant water) for the electrolysis, there are however also disadvantages of high-temperature electrolyses that, as well as the low operating flexibility, relate in particular also to material usage. The choice of materials for the electrodes and the electrolytes in a solid oxide electrolysis cell is important here. One option that is being investigated for the process uses yttrium oxide-stabilized zirconium oxide (YSZ) electrolytes, nickel-cermet steam-hydrogen electrodes and mixed oxides of lanthanum-, strontium-, and cobalt-oxygen electrodes. However, economic operation requires not only the availability of inexpensive $CO_2$-neutral energy sources, but also a reduction in capital costs, which are currently (as of 2018) quoted at about € 2500 per kWel and consequently substantially above those of alkaline electrolysis, at € 1000 per kWel.

The invention recognizes these disadvantages and specifically overcomes them through configuring the key thermodynamic operating point of the electrolysis—in a departure both from standard low-temperature electrolyses and from high-temperature electrolyses—in the process control and in the constructive design of the electrolysis plant. For operational control here, the temperature of the water supplied to the electrolysis process and forming the reactant water to be broken down is set such that the reactant water is, prior to splitting, already in a state close or very close to the boiling point of water with regard to the pressure and temperature.

In the context of the present invention, the boiling point or evaporation point of pure demineralized water is for the stated electrolysis purposes understood here as referring to a pair of values in the phase diagram consisting of two variables: the saturation temperature (specifically also the boiling temperature) and the saturation vapor pressure (specifically also the boiling pressure) at the phase transition line between gas and liquid. The boiling point of water is thus made up of the two variables of state—pressure and temperature—at the transition of water from the liquid into the gaseous state. In an open vessel containing water, the boiling point is therefore the point on the temperature scale at which the vapor pressure is equal to atmospheric pressure. In tables, the boiling temperatures are stated at standard pressure, i.e. at 1013.25 hPa. This boiling point is referred to as the standard boiling point and the specified boiling temperature as the standard boiling temperature.

The boiling temperature is therefore pressure-dependent in accordance with the vapor pressure curve of water and does not necessarily correspond to the boiling temperature under standard pressure, this being advantageously exploited by the method of the invention.

The thermodynamic process control of the reactant water close or very close to the boiling point of water which is proposed here means that just a small input of heat results, through ohmic heat losses from the electrolysis process into the reactant water, in boiling and evaporation of the reactant water. When considered locally in an area or a volume element in which the breakdown of the reactant water is taking place at the electrode, for instance at the anode in the case of a PEM electrolysis, this thermally-induced boiling process results in the reactant water passing into the gas phase. This means that the water is supplied to the electrolysis process at least partly already in the gas phase, i.e. with the water having a high gas fraction or being at least in a water/steam mixed phase corresponding to the saturation vapor pressure with high gas fraction.

This advantageously lowers the cell voltage needed for breakdown of the water, which brings high operational benefits. According to the Nernst equation, the electrode potential is temperature-dependent and the potential difference across the cell to be provided for the electrolysis, which is referred to as the cell voltage, decreases with the absolute temperature. The energy requirement of the electrolysis consequently decreases in line with the decrease in the cell voltage, provided an operating point is set along the vapor pressure curve at which the boiling temperature is higher than under standard conditions at the standard boiling temperature. At a temperature of 25° C., the reversible cell voltage for both water electrolysis and the hydrogen-oxygen fuel cell is 1.23 V at 1013.25 hPa standard pressure.

In addition, the altered thermodynamic operating conditions afford advantages in respect of the choice of catalyst material and the material usage additionally necessary that allow savings to be made on material costs.

The effects of a lower internal cell voltage also prove a major advantage in terms of correspondingly lower degradation of the electrolysis cell, particularly of the membrane electrode assembly, i.e. of the membrane coated on the anode side and on the cathode side with a respective catalyst material. Higher potential differences favor the aging effects that are specifically counteracted in the present case.

In a particularly preferred execution of the method, reactant water is heated through a local input of heat at temperature to the boiling temperature, as a result of which reactant water passes from the liquid phase into the gas phase.

Here, the ohmic heat losses occurring in the electrolysis process are specifically and locally utilized at the membrane in order to bring about the passage into the gas phase through the comparatively low increase in temperature still required. Since the thermodynamic state of the reactant water is set such that this is already at boiling point close below the boiling temperature, it is advantageously only a small temperature difference that must still be overcome and a small heat input that is required, which is available from the process. The small temperature increase in the liquid phase scales with the heat capacity of water of 4.18 KJ/kg·° C. The enthalpy of vaporization of water necessary for vaporization is 2.26 KJ/kg at 100° C. It is independent of the pressure and decreases with increasing boiling temperature of the water.

Preferably, a temperature difference between the temperature of the reactant water and the boiling temperature of less than 5° C., particularly preferably between 1.5° C. and 2.5° C., is set. This allows reactant water in the liquid phase close below the boiling temperature to still be supplied to the electrolyzer efficiently and, ultimately, the ion-conducting membrane to be locally bringing about the input of heat. In the ideal case, almost all the heat losses are advantageously expended on the input of heat, i.e. for the increase in temperature and vaporization of the reactant water. The boiling process is effected locally exactly where the heat losses in the electrolysis process occur, and is utilized in the process control. Advantageously, vaporization is accompanied by a local cooling of the electrolyzer, and of the membrane and of the catalyst in particular, with the result that evaporative cooling is brought about. Additional cooling is no longer necessary.

In a preferred execution of the method, the reactant water is heated at a pressure from a low temperature to a higher temperature such that the thermodynamic state close to the boiling point is reached. Preference is given to isobaric process control starting from a predetermined and defined reactant water pressure. An increase in temperature can be easily realized. The low temperature can for example be the initial temperature or outlet temperature of the demineralized fresh water supplied to the electrolyzer as reactant water, for example initially at a standard temperature of 25° C. This reactant water is then brought to the higher temperature level through a supply of heat and heating or heat exchange. Starting from the higher temperature it is only the heat losses in the process itself that are utilized in order to reach the boiling conditions and to effect vaporization of the reactant water locally at the membrane. The pressure of the reactant water is here advantageously characterized or determined by an operating pressure of the electrolyzer or corresponds to a preferred operating pressure. Here, a distinction can be made between anode-side process and cathode-side process, with a respective pressure that is largely kept constant.

In a further preferred execution of the method, the reactant water is heated to an operating temperature of the low-temperature electrolysis that corresponds to the higher temperature, wherein a higher temperature of up to 130° C., in particular between 90° C. and 120° C., is set.

The temperature range is easily controllable and in addition to heat supplied externally (preheating section) there is available for this purpose, in particular, almost all the process heat from the operation of the electrolysis plant, which is utilized particularly advantageously for this purpose. Through the supply of heat, for example through heating or heat exchange, the reactant water is for instance brought from the temperature level of the fresh water to the desired higher temperature level for the operation of the electrolysis plant, with the result that the desired thermodynamic state of the reactant water close to the boiling point is reached.

In a particularly preferred execution of the method, reactant water is, at a temperature, brought from a high pressure to a lower pressure, with the result that the thermodynamic state close to the boiling point is reached.

Lowering the operating pressure at constant temperature is a particularly advantageous and simple method of reaching the boiling point or boiling conditions through the generation of a negative pressure, with the result that reactant water is brought into the gas phase at said temperature. There is no particular restriction here on the defined temperature of the water, but it is advantageously set at a temperature of 60° C. to 80° C. in the low-temperature electrolysis range, i.e. below the standard boiling temperature of water. The determining factor for this process control is the saturation vapor pressure of water, also referred to in particular as the boiling pressure, at the phase transition line between gas and liquid in the vapor pressure curve. The low pressure or negative pressure required for boiling is advantageously set/brought about in line with the temperature of the reactant water in the electrolyzer or locally at the membrane.

In the method, reactant water is preferably supplied to an anode chamber and to a cathode chamber that are spatially separated by the membrane, the lower pressure being set in the anode chamber. Advantageously, the lowering of the operating pressure is carried out on the anode side of the reaction. For example, in the case of a PEM water electrolysis or an alkaline electrolysis this is the oxygen side, with the result that in the anode chamber oxygen is formed as product gas at the ion-conducting membrane, which is produced as molecular oxygen in the gas phase or passes into the gas phase. As a result of the envisaged boiling condition in the anode chamber, the phase transition from liquid to gaseous is already brought about by the reactant water before the actual electrochemical breakdown. Consequently, a gas-phase reaction of molecular water at (OER: oxygen-evolution reaction) is already favored in the gas phase and predominates in the gas-phase process.

Preferably, a pressure of 200 mbar to 500 mbar, in particular of 300 mbar to 400 mbar, is set in the anode chamber as the lower pressure. Operating temperatures of about 60° C. to 80° C. are thus realizable, the reactant water being set to a corresponding temperature close below the boiling temperature in accordance with the vapor pressure curve of water. The pressure in the anode chamber is here preferably set higher than in the anode chamber, so that the boiling condition is achieved solely in the anode chamber, i.e. on the oxygen side of a PEM electrolyzer or of an alkaline electrolyzer.

This establishes negative-pressure operation for the anode reaction in the anode chamber that is particularly advantageous and easily realizable. Negative-pressure operation down to an operating pressure of preferably less than 600-800 mbar is thus essentially still effectively possible, or else alternatively a low-pressure operation with operating pressures above this of up to max. 1013 mbar in the anode chamber, i.e. at atmospheric pressure or standard pressure.

Preferably, reactant water is vaporized in the anode chamber, with the result that boiling cooling of the membrane is effected.

The boiling process is advantageously set in train locally in the exact place where the heat losses in the electrolysis process occur that are utilized for the vaporization. This results in a local evaporative cooling of the sensitive membrane and further components and materials of the electrolysis cell in the anode chamber and in the cathode chamber that is also precisely localized in respect of thermal load. Even when a certain proportion of the generated water vapor is not electrolytically broken down, this vapor is able to escape from the anode chamber in the same way as the oxygen generated in the electrolysis process. The dissipation of heat is therefore comparable with that of a heat pipe. A heat pipe is a heat-transfer device that utilizes the enthalpy of vaporization of a medium to permit a high heat-flow density. This makes it possible to transfer large amounts of heat on small cross sectional areas. The capacity of a heat pipe for transferring energy is critically dependent on the specific enthalpy of vaporization (in kJ/mol or kJ/kg) of the working medium and advantageously not on the thermal conductivity of the vessel wall or working medium. In order to vaporize a kilogram of water at 100° C. and 1013 mbar (standard conditions), separation work of $\Delta W=2088$ kJ must be expended, heat that will be directly released by the boiling process in the form of a high cooling capacity brought about by vaporization of the environment.

This brings with it a number of advantages:

On account of the process management with particularly efficient and reliable boiling cooling, it is advantageously possible to dispense with cooling of the cathode chamber, i.e. of the hydrogen side of the electrolyzer or of the electrolysis cell. With appropriate plant design it is thus possible on the hydrogen side, i.e. in the cathode chamber, to do without not just the components of the complex cooling systems that are normally necessary, but also the need for a forced water circulation, which results in considerable simplifications of the associated process engineering.

Further advantages of boiling cooling arise from the fact that the temperature-sensitive membrane is now cooled locally, i.e. in a precisely localized manner. Because it is no longer necessary to take account of possible hot spots, it is accordingly possible for the operating temperature of the electrolysis cells to be increased as required. This firstly improves the efficiency of the cell and secondly makes it possible to extract heat and to make use of heat losses at a higher temperature level, which is significantly more efficient in terms of thermodynamic process control.

Since, in the method, practically all heat losses in the electrolysis cell are put into the heating and vaporization of the reactant water, no further cooling of the reactant water present in the anode chamber, i.e. on the oxygen side of the reaction, is necessary. The heat exchangers and other cooling system components that are normally installed in the process water circulation can thus be largely omitted in an electrolysis plant.

Preferably, a higher pressure is established in the cathode chamber than in the anode chamber, a pressure difference $\Delta p$ of 10 bar to 15 bar being maintained.

It is therefore sufficient for the process management that a negative pressure is generated in the anode chamber only. Differential pressure operation also proves particularly advantageous and efficient in terms of plant. A lowering of the operating pressure on the oxygen side of the electrolysis cell is preferably carried out until the boiling conditions have been reached. At preferred pressures of 200 mbar to 500 mbar for negative-pressure operation in the anode chamber, an operating temperature of 60° C. to 80° C. realizable with currently known polymer membranes would result. At these temperatures, today's polymer membranes would still have adequate strength that permits differential pressure operation. Thus, there advantageously exists no absolute need to also operate the cathode chamber, i.e. the hydrogen side of the reaction, at a negative pressure so that the same pressure across the membrane is present in the anode chamber and in the cathode chamber in what is known as equal pressure operation. Instead, the method of the invention affords a more economical operation of the hydrogen side with a few bar overpressure in the cathode chamber relative to the anode chamber.

The object directed at an electrolysis plant is in accordance with the invention achieved by an electrolysis plant having an electrolyzer for generating hydrogen and oxygen as product gases, in which the electrolyzer has a supply line for reactant water and also an anode chamber and a cathode chamber, the anode chamber and the cathode chamber being separated by an ion-exchange membrane, and wherein a product gas line is connected to the anode chamber, in which a vacuum pump is connected that allows a negative pressure to be generated in the anode chamber.

The vacuum pump connected to the anode chamber via the product gas line permits a negative pressure to be provided in the anode chamber such that, when operating the electrolyzer with loading of the anode chamber with reactant water, the boiling condition is realizable through an advantageously essentially isothermal lowering of the pressure. The vacuum pump is connected here such that the suction side of the vacuum pump is connected to the anode chamber. In addition to the negative pressure condition, the vacuum pump at the same time also makes it possible to achieve a highly efficient withdrawal and conveyance of product gas on the oxygen side. This is essentially the product oxygen from the electrolysis process at the membrane in the anode chamber and also gas-phase reactant water that has not been electrochemically split and any minor foreign gas constituents such as product hydrogen.

In terms of plant, the realization of a negative pressure in the anode chamber, i.e. on the oxygen side, is possible here with conventional means, for example very simple and robust screw compressors. In addition to the advantages already described above for the method, the additional plant and energy costs for the vacuum pump and the compressor unit are offset by the following advantages:

On the outlet side, i.e. on the pressure side of the compressor generating the negative pressure or of the vacuum pump, the increase in pressure in the compressor results in an increase in the temperature of the oxygen/hydrogen mixture flowing through. This temperature level is energetically further utilizable.

In a preferred embodiment of the electrolysis plant, a gas cooler is accordingly connected in the product gas line, which is connected downstream of the vacuum pump on the pressure side thereof.

The downstream gas cooler thus allows the waste heat from the electrolyzer to be extracted for further use at a thermodynamically more valuable, elevated temperature level. With appropriate design, the water vapor is advantageously condensed in the gas cooler, so that heat of condensation is available. The compressor then here performs the subsidiary function of an integrated heat pump in advantageous connection with the gas cooler.

In a further preferred embodiment of the electrolysis plant, a supply line that opens into the product gas line is provided, in which a gas pressure control valve is connected, so that a gas, filtered ambient air in particular, can be supplied to the product gas line via the supply line.

It is advantageously possible for precise regulation of the pressure to be effected—in addition to regulation of the speed on the compressor side—by means of a gas pressure control valve that at pressures below an operational setpoint allows, for example, ambient air filtered through a filter to flow into the electrolysis plant.

Preferably, the electrolysis plant alternatively or in addition includes a gas tank that is connected to the supply line, so that a gas can be withdrawn from the gas tank via the gas pressure control valve and supplied to the product gas line.

Here, it is advantageous to hold and store oxygen in gas form in the gas tank. Oxygen is anyhow produced as product gas in the water electrolysis in the anode chamber and is therefore available. This has a beneficial subsidiary effect for the operational safety of the electrolysis plant, namely that the undesirably high foreign gas concentrations that can potentially occur with greater frequency when operated with a partial load, in particular hydrogen as a foreign gas constituent in the oxygen in the anode chamber, can be very effectively diluted by means of the envisaged simple plant components.

Alternatively, instead of ambient air it is possible, as described, to draw in under suction oxygen previously freed of hydrogen, it being possible in both configurations to make efficient use of the available negative pressure on the suction side of the vacuum pump. In order to effect this, the point at which the supply line opens into/is connected to the product gas line is therefore advantageously situated on the suction side of the vacuum pump, i.e. in a section of the product gas line between the outflow from the anode chamber and the inflow into the vacuum pump on the suction side thereof.

Preferably, the electrolysis plant is equipped with a speed control unit connected to the vacuum pump with which the speed of the vacuum pump can be controlled. Thus, in addition to precise pressure control via the gas pressure control valve, a control of the compressor speed is advantageously implemented. This makes it possible, when required, also to precisely control the speed, typically at a settable constant speed setpoint for a desired pressure ratio/compression ratio in respect of the pressure side and the suction side.

Preferably, the vacuum pump is configured as a screw compressor.

Advantageously, the screw compressor is configured as an oil-free compressor. With this, damaging diffusion or passage of oil vapor or other lubricants into the anode chamber with the sensitive ion-exchange membrane is excluded, which further increases operational safety. This is therefore a particularly reliable and robust solution for the intended use. The screw compressor, which is also referred to as a twin-screw pump, screw pump or rotary lobe pump, is what is known as a positive-displacement pump, in which the shape of the rotating displacement units resembles that of a spindle screw. It is the helically toothed variant of the gear pump and counts as a screw compressor. The twin-screw pump consists preferably of two or more counter-rotating rotors and a housing that encloses the rotors. The rotors are designed with regular, threaded profiling and interlock in a gear-like manner. The cavities formed by these three structural elements form the conveying spaces for the medium being conveyed. When the rotors are turning, said cavities move in a machine direction and convey the medium from the suction side (inflow) to the pressure side (outflow).

The screw compressor does not operate in a performance-controlled manner, but at a constant speed. If "too little" oxygen is being produced during operation with a partial load, as is preferred, this is automatically topped up with, for example, easily filtered ambient air through the gas pressure control valve. Alternatively or in addition, oxygen from the gas tank can be supplied. With a 25% partial load, the oxygen produced including the undesired hydrogen fractions can be diluted therewith 1:3 to a safe mixing ratio. This allows the plant to run at an operating interval with a comparatively very low partial load that up to now was not possible on account of the high $H_2$-in-$O_2$ foreign gas concentrations that occur.

Alternatively, instead of ambient air it is possible to use the available negative pressure to draw in, under suction, oxygen that has previously been freed of hydrogen. The achievable dilution effect would be essentially the same. However, ambient air itself contains carbon dioxide, which dissolves in process water and can in turn have an influence on the membrane and electrolysis internals, which can be safely excluded by supplying pure oxygen for dilution.

In a particularly preferred embodiment of the electrolysis plant, the anode chamber and the cathode chamber are separated by a proton-exchange membrane, so that a PEM electrolysis can be carried out.

Advantages and advantageous embodiments of the method of the invention are to be regarded as advantages and advantageous embodiments of the electrolysis plant and vice versa.

Further advantages, features, and details of the invention will become apparent from the description of preferred exemplary embodiments that follows and with reference to the drawing. The features and combinations of features mentioned above in the description and also the features and combinations of features mentioned hereinbelow in the description of the figures and/or shown only in the individual figures are usable not just in the respectively specified combination but also in other combinations or on their own without departing from the scope of the invention.

BRIEF DESCRIPTION OF THE FIGURES

Exemplary embodiments of the invention are more particularly elucidated with reference to a drawing. In the figures, which are in schematic form and are substantially simplified.

DETAILED DESCRIPTION OF THE INVENTION

In the figures, identical reference signs have identical meaning.

Figure 1:
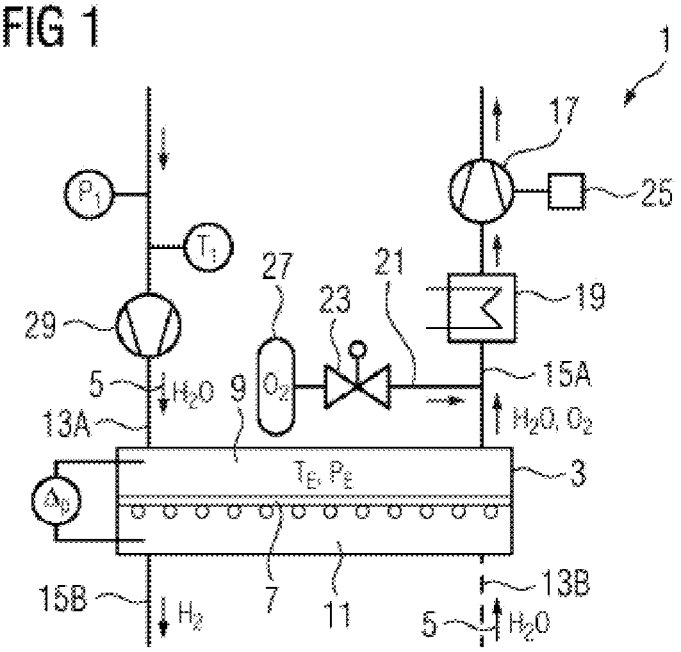
FIG. 1 shows an electrolysis plant configured for differential pressure operation.

FIG. 1 shows a substantially simplified illustration of an electrolysis plant 1 for the electrolysis of water in a PEM electrolysis by way of example. The electrolysis plant 1 includes an electrolyzer 3 having an anode chamber 9 and a cathode chamber 11. The anode chamber 9 and the cathode chamber 11 are separated by a proton-exchange membrane 7. The membrane 7 is coated both on the anode side and on the cathode side with a respective catalyst material, thereby forming a membrane electrode unit. The electrolyzer 3 can here include stacks of electrolysis cells that form a large number of electrolysis cells stacked in a stacking direction and which are not illustrated in more detail. For reasons of clarity, only one anode chamber 9 and one cathode chamber 11 with the membrane 7 are shown, which functionally form an anodic half-cell and the cathodic half-cell separated by the membrane 7. The membrane material includes PFSA (perfluorosulfonic acid).

The electrolysis plant 1 with the electrolyzer 3 is configured for the generation of hydrogen $H_2$ and oxygen $O_2$ as product gases, with operation at or close to the boiling point of water envisaged. For this purpose the electrolyzer has a supply line 13A for reactant water 5 and a product gas line 15A that is connected to the anode chamber 9. The supply line 13A opens into the anode chamber 9. A supply line 13B for reactant water 7 that opens into the cathode chamber 11 is only optionally present. For the feed and supply of reactant water 7 to the electrolyzer, the supply line 13A is sufficient, through which both the anode chamber 9 and the cathode chamber 11 can be supplied in equal measure. A circulation pump 29 in the supply line 13A ensures a particularly even circulation of reactant water 5 around the system under as far as possible constant pressure conditions. The circulation is set up so as to be able to supply fresh demineralized water $H_2O$ (not shown in more detail in FIG. 1), in order to continuously compensate for the reactant water 5 consumed by the electrolysis process and the splitting of water $H_2O$ into the product gases hydrogen $H_2$ and oxygen $O_2$. It is also possible via the optional supply line 15B for fresh demineralized water $H_2O$ to be supplied directly to the cathode chamber 11 as required.

A product gas line 15A is connected to the anode chamber 9. The anode-side products oxygen $O_2$ and residual water in the gas phase can be discharged from the anode chamber 9 through said product gas line 15A. A vacuum pump 17 configured as a screw compressor is for this purpose connected in the product gas line 15A downstream of the anode chamber 9. The suction side of the vacuum pump 17 faces toward the anode chamber 9 and the pressure side faces away from the anode chamber, so that a negative pressure can be continuously generated in the anode chamber 9 during operation of the electrolysis plant, which provides and maintains a thermodynamic state close to the boiling point of the reactant water 7. Integrated into the product gas line 15A downstream of the vacuum pump 17 is a gas cooler 19. This makes available the utilizable heat arising from the compression of the anode-side products, which is transferrable and is energetically utilizable for further use in the electrolysis plant 1. For instance, reactant water 7 can be preheated in a preheating section before being supplied to the anode chamber 9 via the supply line 13A to the electrolysis process.

In addition, a supply line 21, in which a gas pressure control valve 23 is connected, opens into the product gas line 15A. Pure oxygen $O_2$ can be supplied to the product gas line 15A as required via the supply line 21. Oxygen $O_2$ for this purpose is stored in a gas tank 27 that is connected to the supply line 21. Oxygen can thus be withdrawn from the gas tank 27 via the gas pressure control valve 23 and supplied to the product gas line 15A. Such a demand can arise for example during operation of the electrolysis plant 1 with a low partial load, when the logged concentration of foreign hydrogen $H_2$ in the product gas oxygen $O_2$ from the anode chamber 9 is undesirably high and needs to be effectively countered. Connected to the vacuum pump 17 is a speed control unit 25, so that the speed of the vacuum pump 17 can be precisely controlled.

Figure 2:
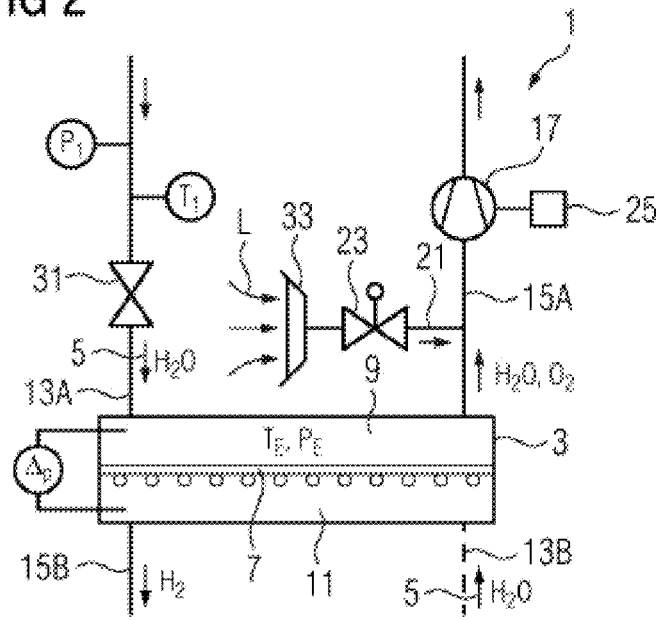
FIG. 2 shows an electrolysis plant in an alternative configuration.

FIG. 2 shows an alternative embodiment of the electrolysis plant 1 from FIG. 1 that differs in respect of the supply line 13A for the reactant water 5 and the supply line 21 that opens into the product gas line 15A. Thus, in FIG. 2, instead of a circulation pump 29, a pressure-maintenance valve 31 or restrictor that can be set to a nominal pressure is integrated into the supply line 13A. The pressure-maintenance valve 31 serves to ensure that the pressure on the inlet side of the valve remains constant. It is used there in order to ensure that the pressure in the supply line 15A remains constant or where a particular counterpressure needs to be generated for e.g. the vacuum pump 17, which in the present case is very advantageous.

The pressure-maintenance valve 31, also referred to as a pressure-limiting valve, ensures that the specified working pressure for the pressure-maintenance valve 31 is maintained and thus ensures a working pressure in the anode chamber 9 that is as constant as possible via a pressure-controlled supply of reactant water 5 through the supply line 13A into the anode chamber 9. When the fall in pressure is too high, the pressure-limiting valve 31 closes in order to prevent even more pressure from being discharged; when the set pressure is reached, the pressure-maintenance valve 31 reopens in order to keep the pressure upstream of the valve constant.

FIG. 2 in addition shows an alternative embodiment of the supply line 21 from FIG. 1 that is connected to the product gas line 15A. This is set up such that ambient air filtered as gas can be drawn in by suction when required. A suction unit having a filter element 33 is provided for this purpose and is connected to the supply line 21 instead of the oxygen gas tank 27 in FIG. 2. The gas pressure control valve 23 ensures a supply of purified and filtered ambient air as required, for operation at a partial load for instance. During operation of the electrolysis plant 1 with a partial load or possibly in normal operation, the negative pressure provided by the vacuum pump 17 ensures that the ambient air flows automatically into the product gas line 15A as soon as the gas pressure control valve opens accordingly.

During operation of the exemplary electrolysis plant 1, a PEM electrolysis under boiling conditions of the reactant water 5 is carried out in the electrolyzer 3. In this process, hydrogen $H_2$ and oxygen $O_2$ are generated as product gases from the reactant water 5 brought into the gas phase.

Water is supplied to the electrolyzer 1 as reactant water 5 via the supply line 13A and is split at the proton-exchange membrane into hydrogen $H_2$ and oxygen $O_2$. Prior to the electrochemical splitting, the reactant water 5 has already been brought to a thermodynamic state close to the boiling point of water with regard to the pressure $p_E$ and temperature $T_E$ and is supplied to the proton-exchange membrane 7 in this state. In the anode chamber 9, the reactant water 5 thus treated in respect of thermodynamic state is brought to the boil, thereby passing into the gas phase, only once it is directly at the membrane 7. This results in the reactant water 5 being split in the gas phase at the membrane 7.

In the present exemplary embodiment employing the electrolysis plant 1 shown in FIG. 1 and FIG. 2, process management in negative-pressure operation is very advantageously possible in order to achieve the boiling condition at moderate operating temperatures. For this, reactant water 5 is first supplied to the electrolyzer 3 via the supply line 13A at an initial temperature $T_1$ and an initial pressure $p_1$ or is fed in as demineralized fresh water. The value of the initial temperature $T_1$ in the supply line 13A can be a fresh water temperature of for example $T_1$=25° C., or the reactant water 5 can, through circulation in the process, already have been prewarmed to a correspondingly higher temperature $T_1$23° C. as an element of the process. The initial pressure $p_1$ is at least $p_1$=1013 mbar. The reactant water 5 is supplied to the anode chamber 9 via the supply line 13A and brought to the operating temperature $T_E$ through heat transfer making use of the process heat arising in the electrolysis process, the temperature $T_E$ being set from 60° C. to 80° C. as the operating temperature. From the initial pressure or high pressure $p_1$ of $p_1 \leq 1013$ mbar, i.e. at least atmospheric pressure, the reactant water 5 in the anode chamber 9 is now brought to a lower pressure $p_E$, so that the thermodynamic state close to the boiling point is reached at the set operating temperature $T_E$. Reactant water 5 is supplied to an anode chamber 9 and to a cathode chamber 11 spatially separated by the membrane 7, the lower pressure $p_E$ being set in the anode chamber 9, so that a differential pressure operation with a pressure difference $\Delta p$ is carried out. In the anode chamber 9 a pressure of 200 mbar to 500 mbar, in particular of 300 mbar to 300 mbar, is set as lower pressure $p_E$. This pressure level is reached and maintained through operation of the vacuum pump 17. The reactant water 5 is vaporized in the anode chamber 9, so that a very efficient boiling cooling of the membrane 7 is at the same time effected, this being achieved through the enthalpy of vaporization available for the vaporization of the reactant water 5 from the process heat of the electrolysis. This means that nearly all the operational "heat losses" are returned directly to the electrolysis process and effectively utilized locally at the membrane 7, instead of the heat being discharged from the process via external cooling circuits and heat sinks. In this negative pressure mode of operation with a pressure difference $\Delta p$, a higher pressure is set in the cathode chamber 11 than in the anode chamber 9. A constant pressure difference $\Delta p$ in the range from 10 bar to 15 bar, optionally in the range 12 bar to 14 bar, is maintained here. In the anode chamber 9 a temperature is maintained that corresponds to the boiling temperature $T_B$ of water under the chosen thermodynamic state for the operation, where $T_E \approx I_B$ for the temperatures at pressure $P_E$. For the cathode chamber 11 it is advantageous when the temperature is set to about the same temperature $T_E$ as in the anode chamber 9. On the other hand, it is advantageous to set the pressure in the cathode chamber 11 higher than the pressure $p_E$ in the anode chamber 9, as explained above. As a result, the boiling condition is intentionally brought about in the anode chamber 9 only locally. Setting the same temperature level in the cathode chamber 11 and in the anode chamber 9 advantageously makes it possible to use the reactant water 5 on the anode side and on the cathode side in equal measure and to circulate unused reactant water 5 or demineralized fresh top-up water. There is no need for completely separate supply circuits for reactant water 5.

In principle the invention opens up various options for reaching the boiling condition. The operational control/method is thus not limited to negative-pressure operation, as set out in FIG. 1 and FIG. 2. Also possible is low-pressure operation at pressures $p_E$ of up to about 1013 mbar, i.e. atmospheric pressure, at which the boiling condition is achieved. Low-temperature electrolyses with operating temperatures of up to 130° C. are advantageous and flexibly possible, with utilization of the heat losses for the vaporization process.

Figure 3:
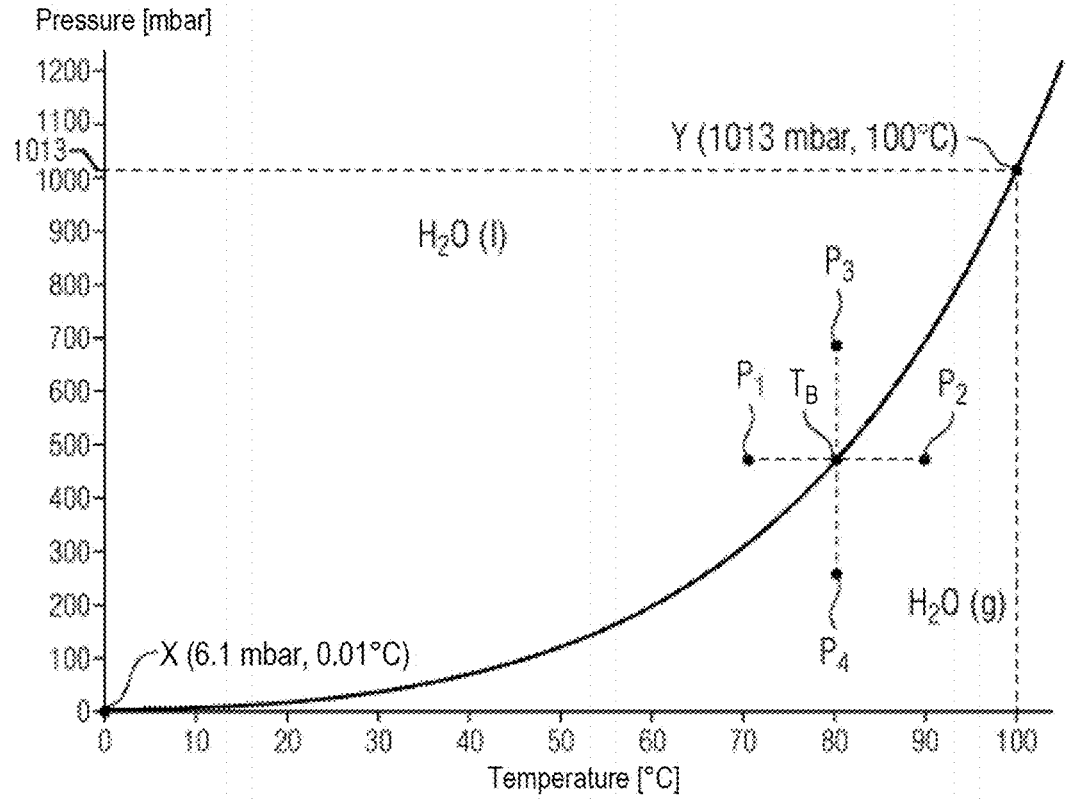
FIG. 3 shows a phase diagram illustrating various changes in the state of the reactant water.

The possibilities that are in principle available are illustrated below with reference to FIG. 3. FIG. 3 shows, on the basis of the phase diagram of water, various changes of state of the reactant water 7 within an operating range at an exemplary temperature of $T_E$=80° C. At this starting point chosen by way of example, the reactant water 7 is in equilibrium with its gas phase at a boiling temperature $T_E \approx T_B \approx$~80° C. and a boiling pressure or saturation vapor pressure of $p_E \approx p_B$=474 mbar:

$$H_2O(g) \leftrightarrows H_2O \quad (1)$$

The responses of the system to the changes in individual state variables such as pressure and temperature amount to a shift of the position of equilibrium. The phase transition that results in the disturbance being reversed again is the one that is most favored according to the principle of least constraint. We consider here various thermodynamic changes of state $P_1$, $P_2$, $P_3$, and $P_4$ close to the boiling point $T_B$.

$P_1$: If the system is cooled to a temperature of $T_E$=70° C., the vapor pressure of the gas phase is too high and water vapor continues to condense until the vapor pressure has the new equilibrium value of 312 mbar or there is no water in the gaseous state remaining. This process control results in condensation and would result in the reactant water 5 having a thermodynamic state away from the boiling point of water.

$P_2$: If the system is on the other hand heated to 90° C., the vapor pressure of the gas phase is too low and water continues to vaporize until the vapor pressure has the new equilibrium value of 702 mbar or there is no liquid water remaining. This corresponds to an isobaric temperature increase until boiling of the reactant water 7 and can also be advantageously applied and transposed to the low-temperature electrolysis range up to 130° C.

$P_3$: If on the other hand the pressure is increased from 474 mbar to 700 hPa while keeping the temperature constant, the vapor pressure of the gas phase is too high and water in the gaseous state continues to condense until the vapor pressure has the former equilibrium value of 474 mbar or there is no water vapor remaining. This process control results in condensation and would result in the reactant water 5 having a thermodynamic state away from the boiling point of water.

$P_4$: If the pressure is lowered from 474 mbar to 250 mbar while keeping the temperature constant, the vapor pressure of the gas phase is too low and water continues to vaporize until the vapor pressure has the former equilibrium value of 474 hPa or there is no liquid water remaining. This corresponds to the negative-pressure operation with boiling cooling in which an isothermal lowering of the pressure is carried out, as elucidated on the basis of the exemplary embodiments of the electrolysis plant according to FIG. 1 and FIG. 2.

Therefore, according to the invention, to achieve vaporization of the reactant water 5 it is proposed to advantageously carry out the process utilizing the changes of state $P_2$ or $P_4$. Combinations of these changes of state are also possible here in order to achieve the respective boiling condition through increasing the temperature according to $P_2$ and/or lowering the pressure according to $P_4$. Also possible when applying the boiling condition in the anode chamber 9 are thermodynamic states and operating conditions beyond the standard boiling point Y with temperatures $T_E \approx T_B$ above the standard boiling temperature of 100° C. and pressures above the standard boiling pressure of 1013 mbar. What is important is that the reactant water 5 is brought to a thermodynamic state close to the respective boiling point with regard to the pressure and temperature.

A local input of heat then results in the reactant water being heated at the membrane, for example from the temperature $T_E$ close below the boiling temperature Is to the boiling temperature $T_B$, as a result of which reactant water 5 passes from the liquid phase into the gas phase. The final step in the process management is the vaporization step. This takes place locally, directly at the membrane 7, utilizing the heat losses. The difference in temperature that is chosen between the temperature $T_E$ of the reactant water 5 and the boiling temperature $T_B$ is therefore low;

this difference in temperature is preferably considerably less than 5° C. and better still is only between 1.5° C. and 2.5° C.

Figure 4:
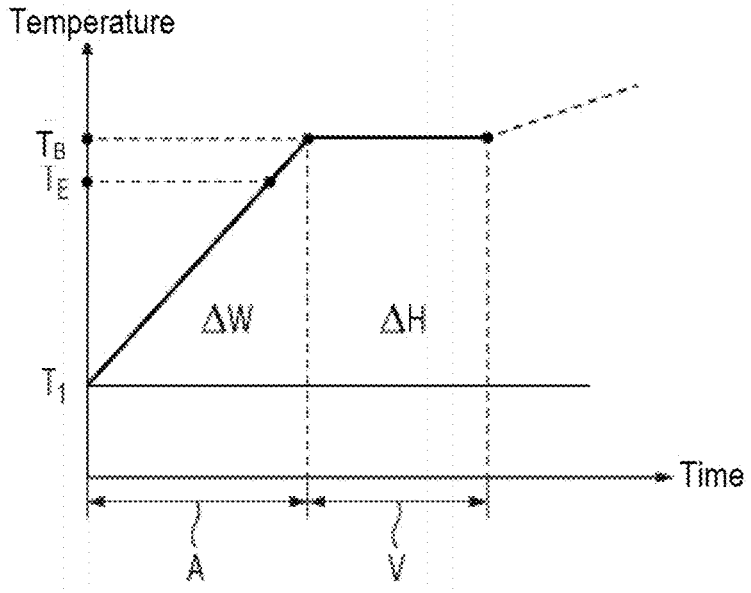
FIG. 4 shows a schematic representation of a temperature profile for the reactant water in the water electrolysis.

FIG. 4 shows by way of example, in schematic and substantially simplified form, a temperature profile with energy consumption for a standard amount of 1 kg of reactant water 7 fed into the electrolyzer 3 of an electrolysis plant 1 as fresh water under standard conditions of 1013 mbar and 25° C. and subjected to the process. In a simple consideration here, the pressure is kept constant at an initial pressure $p_1=p_E=1013$ mbar, i.e. the pressure remains unchanged. The reactant water 5 is now heated at constant pressure pr from a low temperature $T_1=25°$ C. to the higher temperature $T_E=97.5°$ C., for example in a preheating section in the supply line 13A and in the anode chamber 9 itself. This results in the reactant water 5 being brought close below the boiling temperature of water $T_B=100°$ C. at standard pressure, so that a thermodynamic state close to the boiling point is reached, where $T_B-T_E=2.5°$ C. The process heat available from the electrolysis that is transferred to the reactant water 5 in this warm-up phase A is expended as heat energy here. The reactant water 5 is warmed up/heated further in the immediate vicinity of the surface of the catalytically coated membrane 7 until reaching the boiling temperature $T_B=100°$ C., until boiling is brought about. An energy demand of $\Delta W=315$ KJ/kg is required for this purpose in the warm-up phase, since a temperature difference of 75° C. has been expended. In the vaporization phase V that follows, the reactant water now vaporizes completely and passes into the gas phase for the electrolytic breakdown reaction at the membrane 7.

However, during the phase transition of the liquid to a gas the temperature remains constant, provided the pressure remains constant too, which is the case here. All thermal energy supplied is thus invested in the change of state. In the vaporization phase V, an enthalpy of vaporization $\Delta H$ is required, which is taken from the process heat directly at the membrane 7 and from the anode chamber 8, thereby achieving effective boiling cooling of the sensitive membrane 7. The boiling cooling or evaporative cooling is, by comparison with competing methods such as heat conduction, convection, and heat radiation, the most effective option for extracting heat/thermal energy from a system or object, which is made use of very advantageously in the present case. In the vaporization phase V, the enthalpy of vaporization to be supplied under isobaric conditions at 100° C. and 1013 mbar per kg water is $\Delta H=2257$ KJ/kg. The splitting of the reactant water 7 at the membrane 7 takes place exclusively or predominantly in the gas phase, which is very efficient. Further heating of the gaseous reactant water 5 beyond the vaporization phase therefore plays virtually no role. This phase of further temperature increase is therefore indicated in the diagram in FIG. 4 only with a dashed line.

It is therefore possible to heat the reactant water 5 at an operating temperature of the low-temperature electrolysis that corresponds to a temperature $T_E$ considerably higher than the initial temperature $T_1$ of 25° C., it being possible to set a higher temperature $T_E$ of up to 130° C. In association therewith, it is also possible to apply a correspondingly higher operating pressure pr for reaching the boiling condition. For a low-temperature electrolysis, the temperature $T_E$ is advantageously set between 90° C. and 120° C.

The invention claimed is:

1. A method for operating an electrolysis plant having an electrolyzer with an ion-exchange membrane for generating hydrogen and oxygen as product gases, the method comprising:

supplying water to the electrolyzer as reactant water and splitting the water into hydrogen and oxygen at the ion-exchange membrane;

prior to splitting, bringing the reactant water to a given thermodynamic state close to a boiling point of the water with regard to pressure and temperature and supplying the water in the given thermodynamic state to the membrane; and bringing the reactant water to a boil at the membrane and thereby passing the water into a gas phase, and splitting the reactant water in the gas phase at the membrane.

2. The method according to claim 1, which comprises heating the reactant water through a local input of heat at the membrane from the temperature close to the boiling temperature to a boiling temperature, to cause the reactant water to pass from the liquid phase into the gas phase.

3. The method according to claim 2, wherein a temperature difference between the temperature close to the boiling point and the boiling temperature of less than 5° C.

4. The method according to claim 3, wherein the temperature difference between the temperature close to the boiling point and the boiling temperature lies between 1.5° C. and 2.5° C.

5. The method according to claim 1, which comprises heating the reactant water at a pressure from a lower temperature to a higher temperature to reach the given thermodynamic state close to the boiling point.

6. The method according to claim 5, which comprises heating the reactant water to an operating temperature of a low-temperature electrolysis that corresponds to the higher temperature, and setting the higher temperature at up to 130° C.

7. The method according to claim 6, which comprises setting the higher temperature between 90° C. and 120° C.

8. The method according to claim 1, which comprises bringing the reactant water to the given thermodynamic state close to the boiling point by bringing the water, at a given temperature, from a high pressure to a lower pressure.

9. The method according to claim 8, which comprises supplying the reactant water to an anode chamber and to a cathode chamber that are spatially separated by the membrane, and setting the lower pressure in the anode chamber.

10. The method according to claim 9, which comprises setting a pressure of 200 mbar to 500 mbar in the anode chamber as the lower pressure.

11. The method according to claim 10, which comprises setting the lower pressure in the anode chamber to between 300 mbar and 400 mbar.

12. The method according to claim 8, which comprises vaporizing the reactant water in the anode chamber to thereby effect a boiling-by-cooling of the membrane.

13. The method according to claim 8, which comprises establishing a pressure in the cathode chamber that is higher than a pressure in the anode chamber, and maintaining a pressure difference of 10 bar to 15 bar.

* * * * *